US011491362B2

(12) United States Patent
Anderson

(10) Patent No.: US 11,491,362 B2
(45) Date of Patent: Nov. 8, 2022

(54) MULTI-USE WEIGHT LIFTING APPARATUS

(71) Applicant: Iron Warrior LLC, Webster, SD (US)

(72) Inventor: Kory Anderson, West Fargo, ND (US)

(73) Assignee: Iron Warrior LLC, Webster, SD (US)

( * ) Notice: Subject to any disclaimer, the term of this patent is extended or adjusted under 35 U.S.C. 154(b) by 0 days.

(21) Appl. No.: 17/062,842

(22) Filed: Oct. 5, 2020

(65) Prior Publication Data

US 2022/0105381 A1 Apr. 7, 2022

(51) Int. Cl.

| | |
|---|---|
| ***A63B 21/075*** | (2006.01) |
| ***A63B 21/06*** | (2006.01) |
| ***A63B 21/00*** | (2006.01) |
| ***A63B 21/072*** | (2006.01) |

(52) U.S. Cl.

CPC ..... *A63B 21/075* (2013.01); *A63B 21/0604* (2013.01); *A63B 21/0728* (2013.01); *A63B 21/4035* (2015.10)

(58) Field of Classification Search

CPC ..... A63B 21/075; A63B 21/0604; A63B 21/0728; A63B 21/4035; A63B 21/0004; A63B 21/00058–00065; A63B 21/06; A63B 21/0607; A63B 21/072–075; A63B 21/4023; A63B 21/00061–00065; A63B 2244/09

See application file for complete search history.

(56) References Cited

U.S. PATENT DOCUMENTS

| | | | | |
|---|---|---|---|---|
| 4,018,442 | A * | 4/1977 | Galler | A63B 21/0724 482/106 |
| 8,556,781 | B1 * | 10/2013 | Fitzpatrick | A63B 21/169 482/106 |
| 9,844,694 | B2 * | 12/2017 | Birt | A63B 21/4035 |
| 10,561,885 | B1 * | 2/2020 | Lewis, Jr. | A63B 21/0603 |
| 10,773,116 | B2 * | 9/2020 | Vanderbleek | A63B 21/4035 |
| 10,799,752 | B1 * | 10/2020 | Mattox | A63B 21/0724 |
| 2004/0242385 | A1 * | 12/2004 | Emick | A63B 21/0783 482/106 |
| 2011/0028285 | A1 * | 2/2011 | Towley, III | A63B 21/0728 482/108 |
| 2013/0267390 | A1 * | 10/2013 | Warren | A63B 21/075 482/93 |
| 2014/0024505 | A1 * | 1/2014 | Potts | A63B 21/0724 482/106 |
| 2014/0024506 | A1 * | 1/2014 | Vixathep | A63B 21/072 482/108 |

(Continued)

*Primary Examiner* — Joshua Lee
*Assistant Examiner* — Catrina A Letterman
(74) *Attorney, Agent, or Firm* — Womble Bond Dickinson (US) LLP

(57) ABSTRACT

A weight training apparatus, includes a central body comprising a width and a depth, wherein the width of the central body is greater than the depth. The weight training apparatus further includes a first handle comprising an opening coupled to the central body at a first position and a second position on a top surface of the central body, wherein the first handle is positioned laterally relative to the width of the central body, a second handle coupled to the central body at a third position on a first side surface of the central body, and a third handle coupled to the central body at a fourth position on a second side surface of the central body, wherein the second side surface is adjacent to the first side surface.

16 Claims, 4 Drawing Sheets

(56) References Cited

U.S. PATENT DOCUMENTS

| | | | | |
|---|---|---|---|---|
| 2016/0051855 | A1* | 2/2016 | Warren | A63B 21/072<br>482/93 |
| 2016/0236029 | A1* | 8/2016 | Kaszer | A63B 21/0726 |
| 2017/0050073 | A1* | 2/2017 | Kao | A63B 21/0728 |
| 2017/0246495 | A1* | 8/2017 | Wyncott | A63B 21/0728 |
| 2019/0168060 | A1* | 6/2019 | Laurence | A63B 21/072 |
| 2020/0023230 | A1* | 1/2020 | Saldate | A63B 21/0724 |
| 2020/0222746 | A1* | 7/2020 | Obray | A63B 23/03508 |
| 2020/0406085 | A1* | 12/2020 | Reinstein | A63B 21/4035 |
| 2021/0260429 | A1* | 8/2021 | Sarna, II | A63B 21/4035 |

* cited by examiner

MULTI-USE WEIGHT LIFTING APPARATUS

TECHNICAL FIELD

Aspects and implementations of the present disclosure relate to a weight training apparatus and, in particular, to a multi-use kettle bell apparatus.

BACKGROUND

A kettlebell is a weight training apparatus that includes a cast iron or cast steel ball with a handle attached to the top. The kettlebell is used by a user to perform various exercises, such as ballistic exercises, in which the user grips the kettlebell by the handle and swings the kettlebell.

BRIEF DESCRIPTION OF THE DRAWINGS

Embodiments and implementations of the present disclosure will be understood more fully from the detailed description given below and from the accompanying drawings of various aspects and implementations of the disclosure, which, however, should not be taken to limit the disclosure to the specific embodiments or implementations, but are for explanation and understanding only.

DETAILED DESCRIPTION

Aspects and implementations of the disclosure are directed to a multi-use weight lifting apparatus. The weight lifting apparatus includes a central body and multiple handles that enable the weight lifting apparatus to be used to perform a wide variety of exercises.

A conventional gym may include many different pieces of equipment that are each designed for a particular exercise. For example, a conventional gym may have dumbbells for a user to perform curls, kettlebells for a user to perform kettlebell swings, and barbells for a user to perform bench presses and shoulder presses. These different pieces of equipment may be well suited for performing their particular exercises, but may be ineffective are performing other exercises. For example, due to a kettlebell having a single, narrow handle, it may be difficult for a user to perform bench presses, two-handed curls, upright rows, etc. using a kettlebell.

While such a setup may be sufficient for a conventional gym having adequate space and resources to implement multiple pieces of equipment, a home gym may not have sufficient space or monetary resources to include many different pieces of equipment. Rather, a home gym typically requires versatile equipment that may be used to perform a wide variety of exercises. Accordingly, a user may be able to purchase a single piece of equipment to perform a large number of exercises, rather than multiple pieces of equipment, reducing the amount of space and monetary resources that are dedicated to the home gym.

Aspects of the disclosure provide for an improved weight lifting apparatus that includes multiple handles coupled to a central body to enable a wide variety of exercises to be performed using the weightlifting apparatus. Unlike a conventional kettlebell, which includes a single handle coupled to a cast iron or cast steel ball, the improved weight lifting apparatus includes three handles positioned about the central body. The position and orientation of the handles about the central body are optimized to enable the weight lifting apparatus to be used for a wide variety of exercises that a conventional kettlebell may not be suited for. For example, the handles of the weight lifting apparatus may have a wider spacing, making the weight lifting apparatus more suitable for performing upright rows, preacher curls, bench presses, etc. than a conventional kettlebell. Accordingly, a user may be able to replace multiple pieces of equipment with the improved weight lifting apparatus.

Figure 1A:
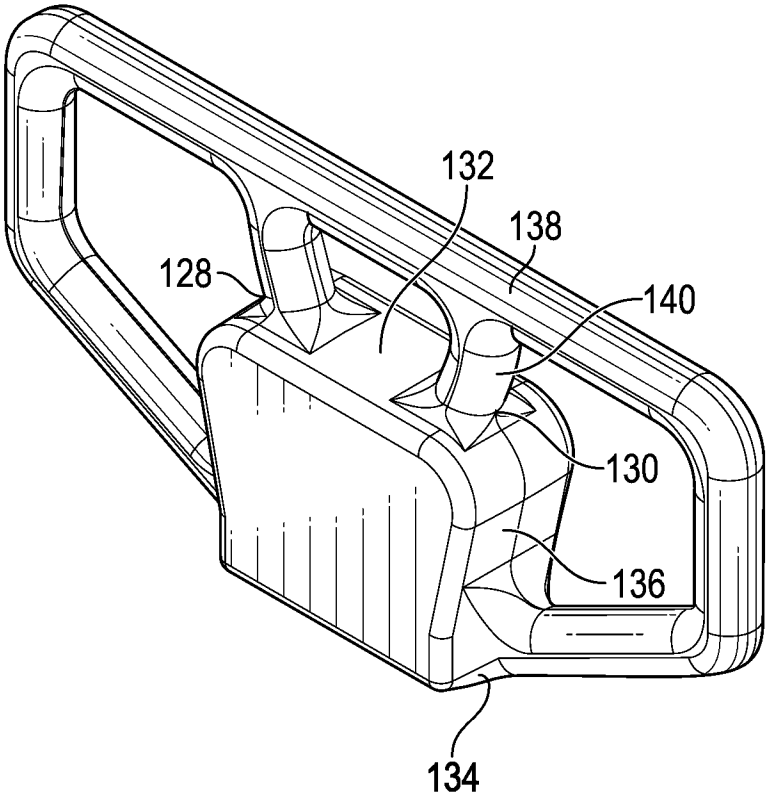
FIGS. 1A and 1B are illustrations of an example of a weight lifting apparatus, in accordance with embodiments of the disclosure.
Figure 1A:
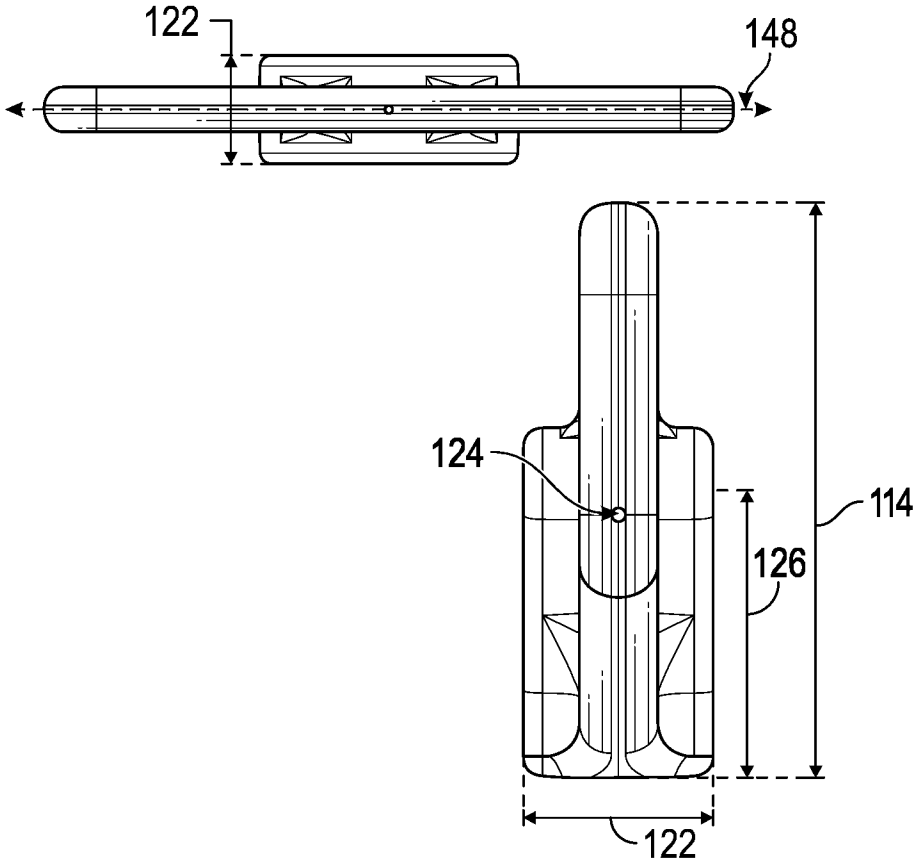
Figure 1B:
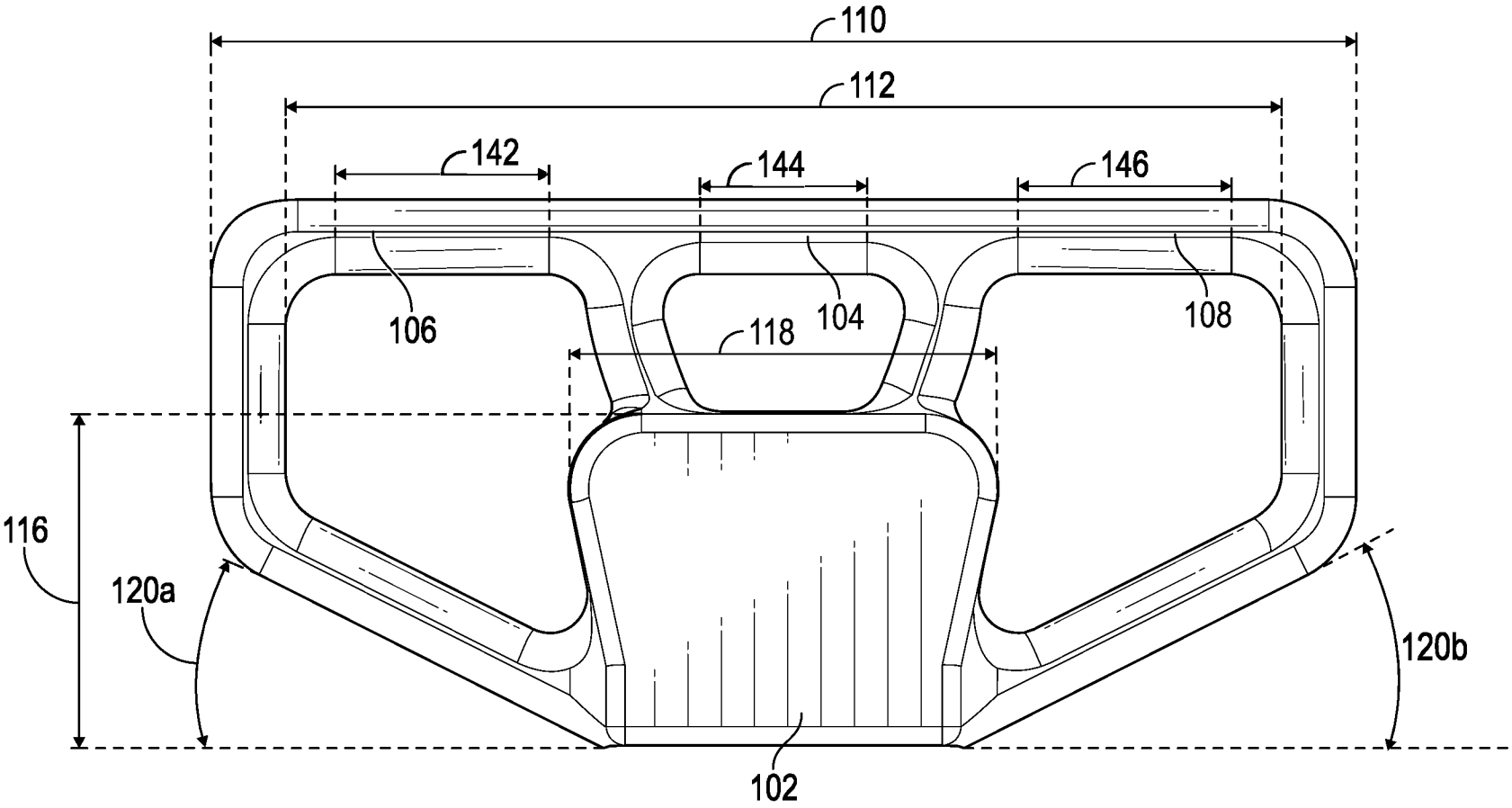

FIGS. 1A and 1B are illustrations of an example of a weight lifting apparatus 100, in accordance with embodiments of the disclosure. The weight lifting apparatus 100 may include a central body 102, a first handle 104, a second handle 106, and a third handle 108. In embodiments, the components of the weight lifting apparatus 100 may be formed of cast iron or cast steel. In some embodiments, the components of the weight lifting apparatus 100 may be formed of other metallic alloys or various materials suitable for a weight lifting apparatus 100. In an embodiment, the components of the weight lifting apparatus 100 may be formed of one or more layers of different materials. For example, the weight lifting apparatus 100 may be formed of a metallic core and an enamel or powder coating deposited over the core. In some embodiments, the vertical height 114 of the weight lifting apparatus 100 may be between 10 and 12 inches.

The central body 102 may be provide a majority of the mass of the weight lifting apparatus 100. The central body 102 may have a width 118 that corresponds to the distance from a first side surface of the central body 102 to a second side surface of the central body 102, a height 116 that corresponds to the distance from the top surface 132 of the central body 102 to a bottom surface of the central body 102, and a depth 122 that corresponds to the distance from the front surface of the central body 102 to the rear surface of the central body 102. In embodiments, the central body 102 may have a first width near the top of the central body 102 and a second width near the bottom of the central body 102. In some embodiments, the first width may be greater than the second width. In other embodiments, the first width may be less than the second width. In embodiments, the width 118 of the central body 102 may be determined based on providing sufficient width so that the weight lifting apparatus 100 is stable when resting on a planar surface. In some embodiments, the depth 122 of the central body may be between 3 inches and 4 inches to allow for a compact design and increase the functional use of weight lifting apparatus 100. In embodiments, the shape of the central body 102 may be based on optimizing the available handle area near the bottom of the central body 102 and moving the center of gravity 124 of the weight lifting apparatus 100 near the vertical center 126 of the weight lifting apparatus 100, preventing the weight lifting apparatus from being top heavy and unstable. The center of gravity 124 of the weight lifting apparatus 100 may correspond to a point within the weight lifting apparatus 100 upon which the total weight of the weight lifting apparatus 100 may be concentrated.

The central body 102, first handle 104, second handle 106, and/or third handle 108 may be formed of different material(s) and/or have different dimensions to achieve a desired total weight for the weight lifting apparatus. For example, the central body 102 of a 75 pound weight lifting apparatus may be formed of a heavier material and/or have larger dimensions than the central body 102 of a 35 pound weight lifting apparatus.

The first handle 104 may be coupled to the central body 102 at position 128 and position 130 on a top surface 132 of the central body 102. The first handle 104 may be positioned laterally relative to the width 118 of the central body 102. In embodiments, the first handle 104 may be positioned along a lateral axis 148 that is parallel to the front and rear surfaces of the central body 102 and passes through the center of gravity 124 of the weight lifting apparatus 100. The shape of the first handle 104 may form an opening to allow a user to grip the first handle 104 to facilitate the performance of various exercises using the weight lifting apparatus 100. The first handle 104 may have a width 144. The width 144 may be determined based on hand dimensions of a potential user of the weight lifting apparatus 100 to ensure a user can comfortably perform the various exercises while gripping the weight lifting apparatus 100 by the first handle 104. In embodiments, the width 144 of the first handle 104 may be between 3 inches and 8 inches.

The second handle 106 may be coupled at a position on a first side surface of the first handle 104 and a position on a first side surface of the central body 102. For clarity, the first side surface of the first handle 104 and the first side surface of the central body 102 are not shown. The third handle 108 may be coupled at position 134 on a second side surface 136 of the central body 102 and position 138 on a second side surface 140 of the first handle 104. The second side surface 136 of the central body 102 may be adjacent to the first side surface of the central body 102 and the second side surface 140 of the first handle 104 may be adjacent to the first side surface of the first handle 104. In embodiments, the second handle 106 and/or the third handle 108 may be positioned along the lateral axis 148 that is parallel to the front and rear surfaces of the central body 102 and passes through the center of gravity 124 of the weight lifting apparatus 100.

The positions, orientations, and shapes of the first handle 104, the second handle 106, and the third handle 108 may be determined to create a larger area for handles on the weight lifting apparatus 100 while providing for a compact design so that the functionality of the weight lifting apparatus 100 and motion movements is optimal.

The first handle 104, the second handle 106, and the third handle 108 may have a diameter that corresponds to the width of the first handle 104, the second handle 106, and the third handle 108. In embodiments, the diameter may be between 1.25 inches and 1.75 inches. In some embodiments, the first handle 104, the second handle 106, and the third handle 108 may have a circular geometry. In embodiments, the first handle 104, the second handle 106, and the third handle 108 may have an elliptical geometry. In an embodiment, the first handle, the second handle 106, and the third handle 108 may have a geometry that includes both planar portions and circular/elliptical portions. The diameter 1111 of the first handle 104, the second handle 106, and the third handle 108 may be determined to provide adequate strength to the structural design of the weight lifting apparatus 100 while providing a functional grip for an average user. In some embodiments, the diameter 1111 may be increased to support the development of greater grip strength for a user and/or heavier weights.

In embodiments, the couplings between the central body 102, the first handle 104, the second handle 106, and the third handle 108 may be integrally formed. For example, the central body 102, the first handle 104, the second handle 106, and the third handle 108 may be formed of cast iron or steel using a mold.

The shape of the second handle 106 may form a second opening and the shape of the third handle 108 may form a third opening to allow a user to grip the second handle 106 and third handle 108, respectively, to facilitate the performance of various exercises using the weight lifting apparatus 100. The second handle 106 may have a width 142 and the third handle 108 may have a width 146. The width 142 and or width 146 may be determined based on hand dimensions of a potential user of the weight lifting apparatus 100 to ensure a user can comfortably perform the various exercises while gripping the weight lifting apparatus 100 by the second handle 106 and/or the third handle 108. In embodiments, the width 142 of the second handle 106 and/or the width 146 of the third handle 108 may be between 3 inches and 8 inches.

The weight lifting apparatus 100 may have an outside width 110 and an inside width 112. The outside width 110 may correspond to the total width of the weight lifting apparatus 100. The inside width 112 may correspond to a width from the side surface of the opening formed by the second handle 106 to the side surface of the opening formed by the third handle 108, as shown in FIG. 1. In embodiments, the inside width 112 may be between 12 inches and 32 inches. In some embodiments, the inside width 112 may be determined based on a total weight of the weight lifting apparatus 100. For example, a weight lifting apparatus 100 having a lighter weight may have a smaller inside width 112 than a weight lifting apparatus 100 having a heavier weight.

The bottom portions of the second handle 106 and third handle 108 may be shaped for form angle 120*a* and angle 120*b*, respectively, relative to the bottom surface of the central body 102. In embodiments, angle 120*a* and angle 120*b* may be between 20 degrees and 35 degrees. Angle 120*a* and angle 120*b* may provide pressure relief on wrists, elbows, and shoulders of a user when gripping the bottom arms of the second handle 106 and third handle 108.

Figure 2:
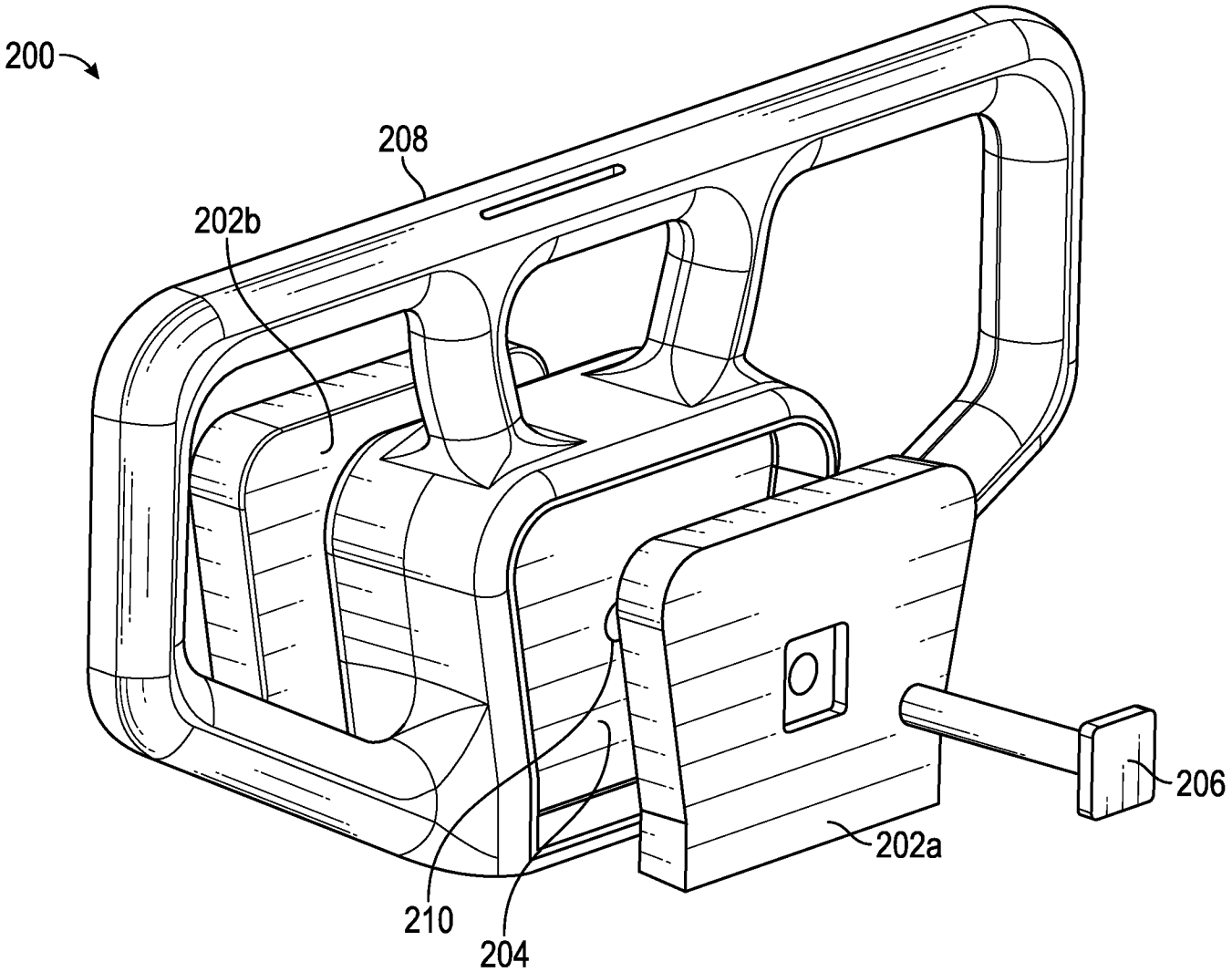
FIG. 2 is an illustration of an example of a weight lifting apparatus including weighted plates, in accordance with embodiments of the disclosure.

FIG. 2 is an illustration of an example of a weight lifting apparatus 200 including weighted plates, in accordance with embodiments of the disclosure. The weight lifting apparatus 200 may include a central apparatus 208 that may include similar components as the weight lifting apparatus 100 of FIG. 1. Weight lifting apparatus 200 may provide for increased versatility by facilitating the addition of weighted plate 202*a* and weighted plate 202*b* to the central apparatus 208. Accordingly, different weighted plates may be added to the central apparatus 208 so that a single central apparatus 208 can be used for a wide range of weights.

In embodiments, weighted plate 202*a* and weighted plate 202*b* may be formed of one or more materials that are similar to the materials of central body 102 of FIG. 1. In some embodiments, weighted plate 202*a* may be shaped to fit within a recessed portion 204 of the front surface of the central apparatus 208 and weighted plate 202*b* may be shaped to fit within a recessed portion (not shown) of the rear surface of the central apparatus 208.

The weight lifting apparatus 200 may include one or more locking mechanisms 206 that securely couple weighted plate 202*a* and/or weighted plate 202*b* to the central apparatus 208. In FIG. 2, the locking mechanism 206 is illustrated as a locking pin that is passed through an opening of the weighted plate 202*a* and inserted into a receptacle 210 on the central apparatus 208 to secure the weighted plate 202*a* to the central apparatus 208. In embodiments, a second locking mechanism (not shown) may be used to secure weighted plate 202*b* to the rear surface of the central apparatus 208. In some embodiments, other types of locking mechanisms may be used to secure weighted plate 202*a* and/or weighted plate 202*b* to the central apparatus 208. Other types of locking mechanisms may include, but aren't limited to, bolt/wingnut assemblies, clamps, straps, brackets, or the like.

Figure 3:
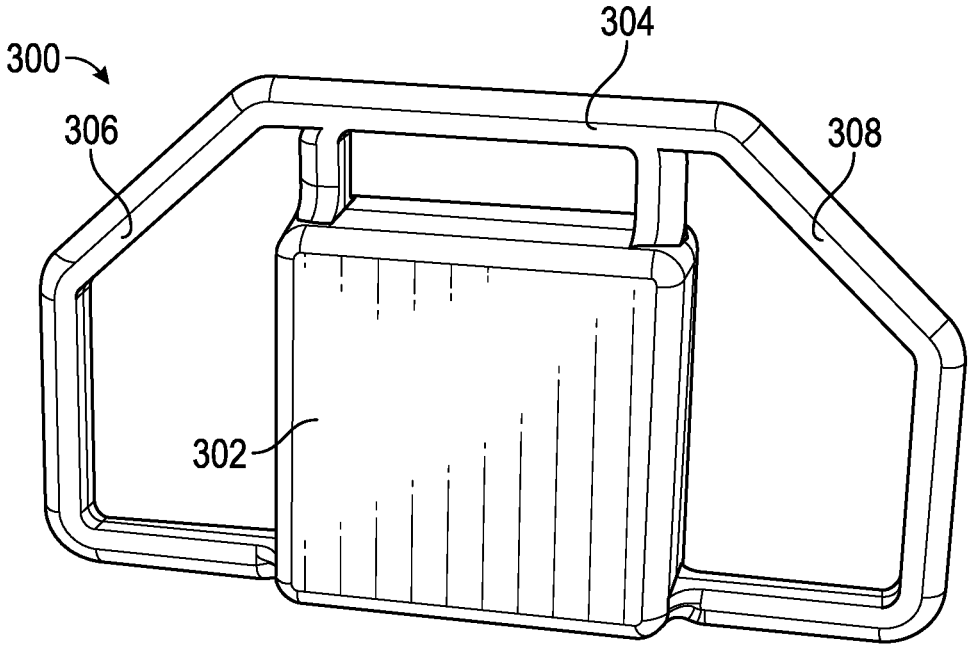
FIG. 3 is an illustration of an example of a first alternative embodiment of a weight lifting apparatus.

FIG. 3 is an illustration of an example of a first alternative embodiment of a weight lifting apparatus 300. The weight lifting apparatus 300 includes a central body 302, a first handle 304, a second handle 306, and a third handle 308, as previously described at FIG. 1. However, in weight lifting apparatus 300 the bottom portions of the second handle 306 and the third handle 308 are substantially planar to the bottom surface of the central body 302, such that the bottom portions of the second handle 306 and the third handle 308 may not form angles (e.g., angle 120*a* and angle 120*b*) relative to the bottom surface of the central body 302. The top portions of the second handle 306 and the third handle 308 may be shaped for form angles relative to the top surface of the central body 302.

Figure 4:
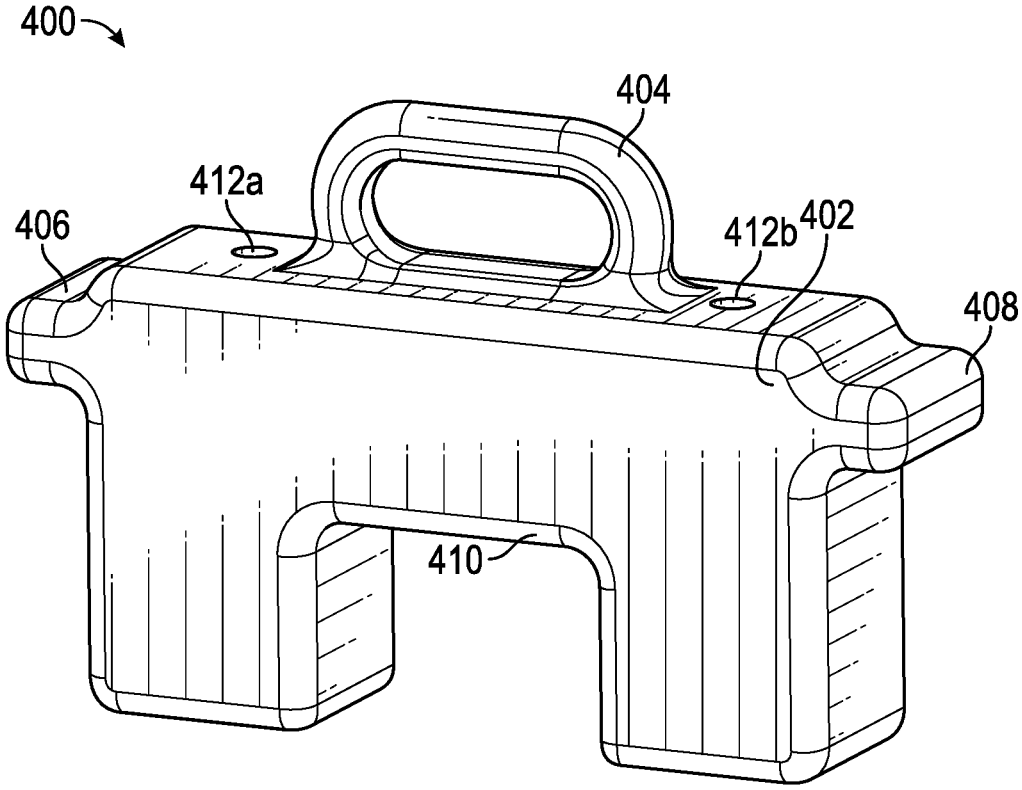
FIG. 4 is an illustration of an example of a second alternative embodiment of a weight lifting apparatus.

FIG. 4 is an illustration of an example of a second alternative embodiment of a weight lifting apparatus 400. The weight lifting apparatus 400 includes a central body 402 and a first handle 404, as previously described at FIG. 1. The weight lifting apparatus 400 may also include a second handle 406 and a third handle 408. The second handle 406 may be a protrusion from a first side surface of the central body 402 and the third handle 408 may be a protrusion from a second side surface of the central body 402 that is adjacent to the first side surface that serve as points for a user to grip the weight lifting apparatus 400.

The weight lifting apparatus 400 may include a cutout 410 in the central portion of the central body 402 and openings 412*a, b* positioned on the top surface of the central body 402. The cutout 410 and/or the openings 412*a, b* may allow the weight lifting apparatus 400 to be placed and fastened onto different variations of equipment so that the weight lifting apparatus 400 may function as compoundable weight using multiples or counterweight.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular embodiments may vary from these exemplary details and still be contemplated to be within the scope of the present disclosure.

Reference throughout this specification to "one embodiment" or "an embodiment" means that a particular feature, structure, or characteristic described in connection with the embodiments included in at least one embodiment. Thus, the appearances of the phrase "in one embodiment" or "in an embodiment" in various places throughout this specification are not necessarily all referring to the same embodiment.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Furthermore, the terms "first," "second," "third," "fourth," etc. as used herein are meant as labels to distinguish among different elements and may not necessarily have an ordinal meaning according to their numerical designation.

What is claimed is:

1. A weight training apparatus, comprising:

a central body comprising a width and a depth, wherein the width of the central body is greater than the depth;

a first handle coupled to the central body at a first position and a second position on a top surface of the central body to form a first loop with a first opening, wherein the first handle is positioned laterally relative to the width of the central body;

a second handle coupled to the central body at a third position on a first side surface of the central body and coupled to a third side surface of the first handle to form a second loop with a second opening;

a third handle coupled to the central body at a fourth position on a second side surface of the central body and coupled to a fourth side surface of the first handle to form a third loop with a third opening, wherein the third side surface and the fourth side surface are on opposite sides of the first handle one or more weighted plates to be secured to at least one of a front surface or a rear surface of the central body; and one or more locking mechanisms to secure the one or more weighted plates to the at least one of the front surface or the rear surface of the central body.

2. The weight training apparatus of claim 1, wherein the first handle, the second handle, and the third handle are centered relative to a center of mass of the central body.

3. The weight training apparatus of claim 1, wherein a first lower portion of the second handle forms a first angle between 20 degrees and 35 degrees relative to a bottom surface of the central body and a second lower portion of the third handle forms a second angle between 20 degrees and 35 degrees relative to the bottom surface of the central body.

4. The weight training apparatus of claim 1, wherein the at least one of the front surface or the rear surface comprises a recessed portion to envelop at least a portion of the one or more weighted plates.

5. The weight training apparatus of claim 1, wherein the first handle, the second handle, and the third handle have corresponding diameters between 1.25 inches and 1.75 inches.

6. The weight training apparatus of claim 1, wherein the first handle, the second handle, and the third handle have corresponding widths between 3 inches and 8 inches.

7. The weight training apparatus of claim 1, wherein a center of gravity of the weight training apparatus is below a center of a vertical height of the weight training apparatus.

8. The weight training apparatus of claim 7, wherein the vertical height of the weight training apparatus is between 10 inches and 12 inches.

9. The weight training apparatus of claim 1, wherein the depth of the central body is between 3 inches and 4 inches.

10. The weight training apparatus of claim 1, wherein the width of the central body comprises a first width near the top surface of the central body and a second width near a bottom surface of the central body, wherein the first width is greater than the second width.

11. The weight training apparatus of claim 1, wherein an inside width between the second handle and the third handle is between 12 inches and 32 inches.

12. The weight training apparatus of claim 1, wherein the central body, the first handle, the second handle, and the third handle are comprised of cast iron.

13. The weight training apparatus of claim 1, wherein the couplings between the central body, the first handle, the second handle, and the third handle are integrally formed.

14. The weight training apparatus of claim 1, wherein the first loop, the second loop, and the third loop lie in a same plane.

15. The weight training apparatus of claim 1, wherein the central body provides a majority of the overall weight of the weight training apparatus.

16. The weight training apparatus of claim 1, wherein a depth of the central body is greater than a diameter of the first handle, the second handle, and the third handle.

* * * * *